United States Patent [19]

Scuderi

[11] Patent Number: 4,981,020

[45] Date of Patent: Jan. 1, 1991

[54] APPARATUS FOR RECOVERING REFRIGERANT

[76] Inventor: Carmelo J. Scuderi, 173 Prospect St., Springfield, Mass. 01107

[21] Appl. No.: 474,925

[22] Filed: Feb. 2, 1990

[51] Int. Cl.[5] ..... F25B 45/00

[52] U.S. Cl. ..... 62/77; 62/149; 62/292

[58] Field of Search ..... 62/77, 149, 292

[56] References Cited

U.S. PATENT DOCUMENTS 3,232,070 2/1966 Sparano ..... 62/77 X 4,363,222 12/1982 Cain ..... 62/292

4,441,330 4/1984 Lower et al. ..... 62/292 X 4,766,733 8/1988 Scuderi ..... 62/292 X

*Primary Examiner*—William E. Tapolcai

*Attorney, Agent, or Firm*—Fisherman, Dionne & Cantor

[57] ABSTRACT

An apparatus for recovering a compressible refrigeration fluid from a refrigeration system and delivering the recovered fluid to a receiver as disclosed. The apparatus includes a discriminator tank for discriminating between influent liquid phase fluid and gas phase fluid. Liquid phase fluid is directed to the receiver. Gas phase fluid is condensed and directed to the receiver. The apparatus further includes a safety tank for preventing overfilling of the receiver and a compressor particularly adapted to refrigerant recovery.

11 Claims, 3 Drawing Sheets

APPARATUS FOR RECOVERING REFRIGERANT

TECHNICAL FIELD

The present invention pertains to the art of refrigeration systems.

BACKGROUND

In view of global concern regarding the environmental consequences attending the release of chlorofluorocarbon refrigerants into the atmosphere, there is now world-wide agreement regarding regulation of the production and use of chlorofluorocarbons. As a result of this regulation, the cost of chlorofluorocarbon refrigerants is expected to rise dramatically.

Accordingly, there has arisen an interest in recovering refrigerant fluids. Commonly assigned U.S. Pat. No. 4,766,733, the disclosure of which is incorporated herein by reference, describes an apparatus for recovering chlorofluorocarbon refrigerants.

SUMMARY OF THE INVENTION

An apparatus for recovering a compressible refrigeration fluid from a refrigeration system and delivering the recovered fluid to a refrigerant receiver is disclosed. The apparatus includes discriminator means for discriminating between gas phase fluid and liquid phase fluid, first conduit means for directing a stream of fluid from the refrigerant system to the discriminator, and second conduit means for directing a stream of liquid phase fluid from the discriminator means to the receiver. The apparatus further includes means for condensing a stream of gas phase fluid from the discriminator means to form a low pressure stream of substantially liquid phase fluid, third conduit means for directing the low pressure stream of substantially liquid phase fluid from the means for condensing to the receiver means, and vent means for directing a stream of fluid from the receiver to the means for condensing. The apparatus of the present invention provides improved efficiency compared to the apparatus described in U.S. Pat. No.4,766,733 and allows refrigerant to be removed from the refrigeration unit in significantly less time than possible with the prior art apparatus.

DETAILED DESCRIPTION OF THE INVENTION

Figure 1:
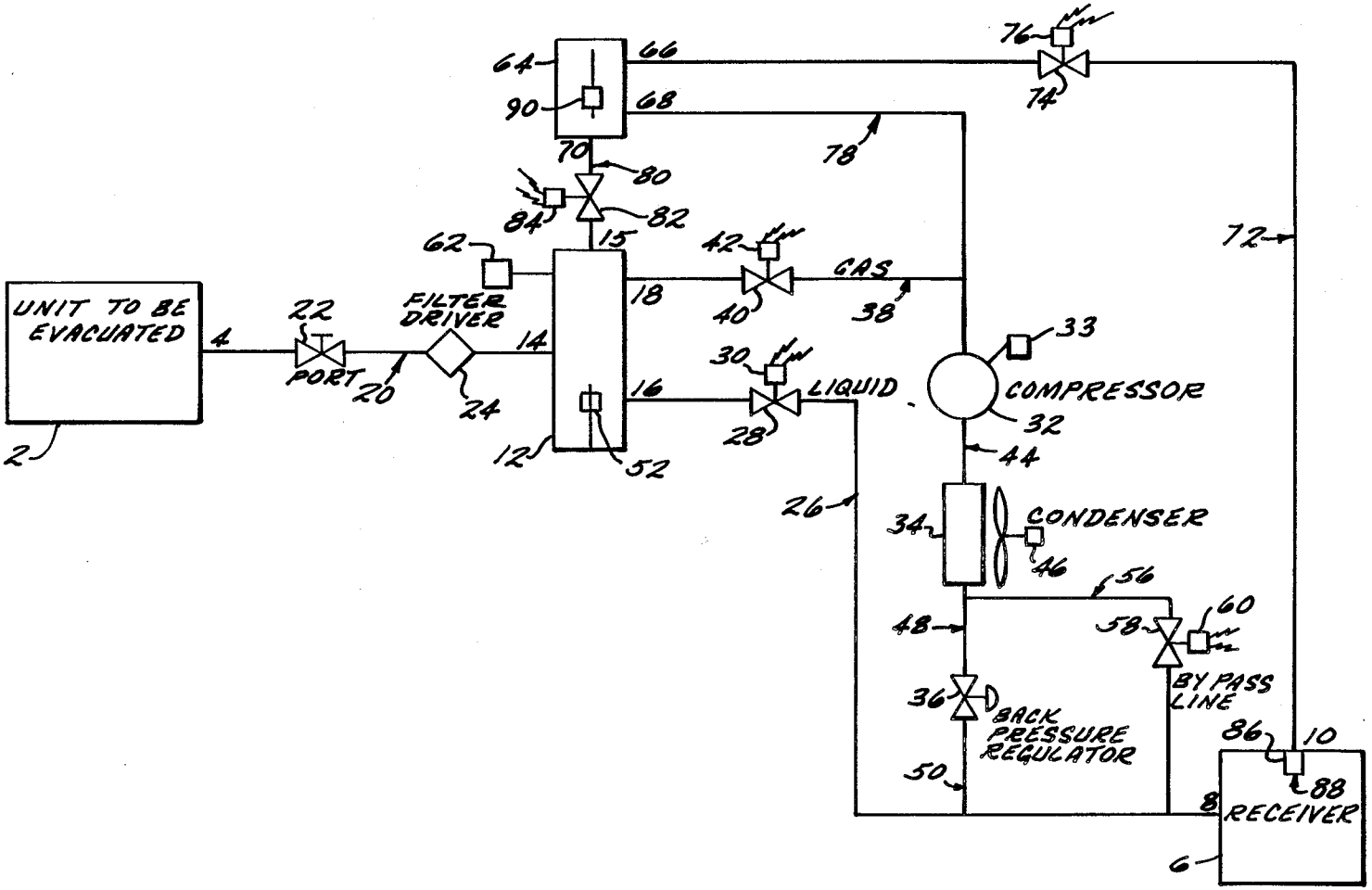
FIG. 1 shows a schematic diagram of the apparatus of the present invention.

The apparatus of the present invention allows recovery of a compressible refrigeration fluid from a refrigeration system 2 and delivery of the recovered fluid to a refrigerant receiver 6. The refrigeration system includes a port 4, the receiver includes first port 8 and second port 10.

The apparatus of the present invention includes a discriminator chamber 12. The discriminator chamber 12 includes an inlet port 14, a liquid inlet port 15, a liquid outlet port 16, and a gas outlet port 18. Conduit 20 provides a fluid flow connection between refrigeration system port 4 and inlet port 14 of the discriminator chamber 12. A valve 22 allows control of flow through conduit 20 and a filter dryer 24 allows removal of moisture and particulate contaminants from the refrigerant removed from the refrigeration system 2. A conduit 26 is provided for directing liquid phase refrigeration fluid from port 16 of discriminator chamber 12 to port 8 of receiver 6. Conduit 26 is provided with a solenoid valve 28 for controlling flow through conduit 26 and an actuator 30 for opening and closing solenoid valve 28.

The apparatus of the present invention includes a compressor 32, a condenser 34 and a back pressure regulator 36 for condensing gas phase refrigerant fluid and providing a low pressure stream of substantially liquid phase fluid to conduit 26. Conduit 38 allows gas phase refrigerant fluid to flow from port 18 of discriminator chamber 12 to compressor 32. Conduit 38 is provided with a solenoid valve 40 for controlling flow through conduit 38. An actuator 42 is provided for opening and closing valve 40. Conduit 44 establishes a fluid flow connection between compressor 32 and condenser 34. Fan 46 provides a flow of air for removing heat from condensor 34. Conduit 48 establishes a fluid flow connection between the condenser 34 and the back pressure regulator 36. Conduit 50 establishes a fluid flow connection between back pressure regulator 36 and conduit 26.

Figure 3:
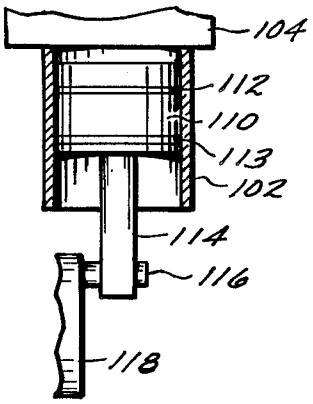
FIG. 3 shows a cross sectional view of a portion of the compressor of the present invention.
Figure 2:
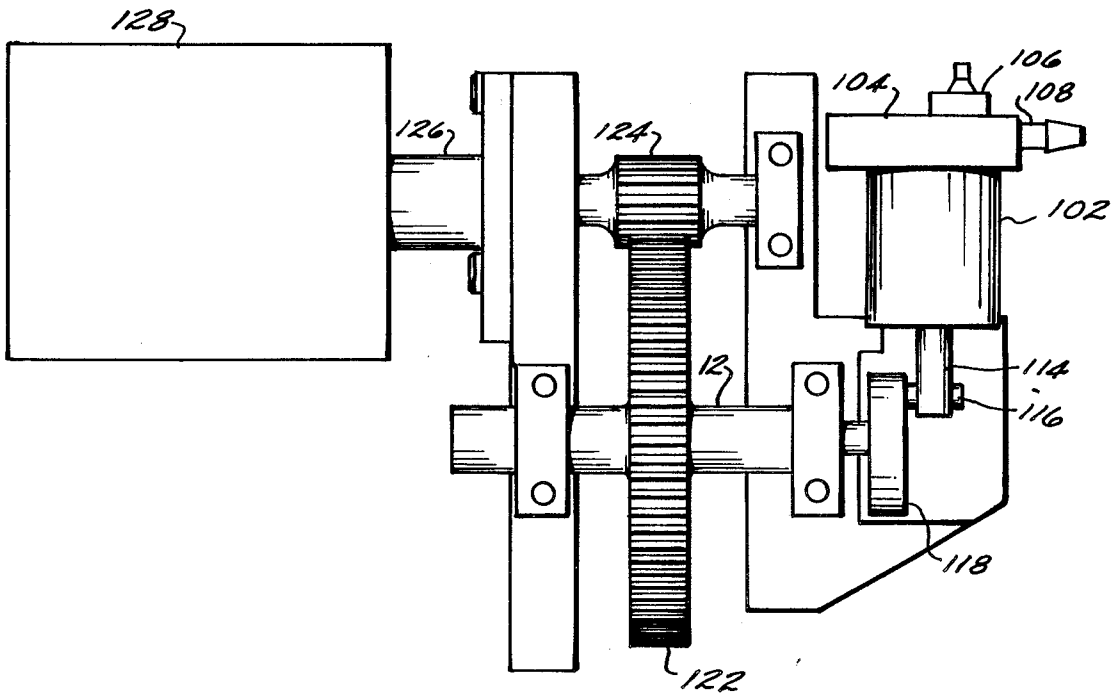
FIG. 2 shows a schematic top view of the compressor of the present invention.

The compressor 32 may comprise a conventional refrigerant compressor or a compressor of the present invention. Referring to FIGS. 2 and 3, a compressor of the present invention includes a tubular cylinder wall 102. The cylinder wall 102 comprises stainless steel. The cylinder head 104 enclosed one end of the tubular cylinder wall 102. The cylinder head 104 is provided with an intake port 106 and an outlet port 108 as well as an intake valve and outlet valve (not shown) for controlling flow through intake port 106 and outlet port 108. A piston 110 is slidably received within the tubular cylinder wall 102. An annular seal 112 circumscribes the piston. Annular seal 112 is a bi-directional self lubricating annular seal for sealing between the piston 110 and tubular cylinder wall 102 so that the apparatus of the present invention provides a high pressure outlet stroke and a vacuum intake stroke. A piston ring 113 is provided to maintain piston 110 axially aligned within the tubular wall 102. A piston rod 114 is provided for reciprocally moving the piston within the tubular cylinder wall 102. The piston rod 114 is rotably mounted on wrist pin 116. Wrist pin 116 is eccentrically secured to member 118. Shaft 120 is provided for rotating member 118. Gears 122 and 124 couple shaft 120 with the output shaft 126 of motor 128.

Figure 4:
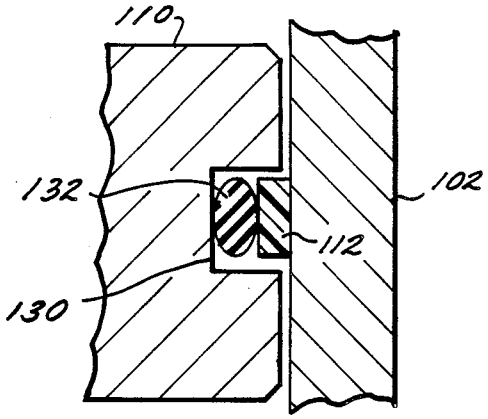
FIG. 4 shows a cross sectional view of a portion of the compressor of the present invention.

FIG. 4 shows one embodiment of the self lubricating bi-directional annular seal of the compressor 32 of present invention. Piston 110 defines an annular groove 130 which circumscribes the piston. Annular seal 112 is disposed within groove 130. Preferably, the annular seal 112 comprises a graphite or carbon filled flouropolymer, e.g. polytetrafluoroethylene. A chemically resistant elastomeric ring 132 urges piston ring 112 towards cylinder wall 102 to provide a bi-directional seal. Preferably, the elastomeric ring 132 comprises a chlorosulfonated polyethylene elastomer or a polychloroprene elastomer.

Figure 5:
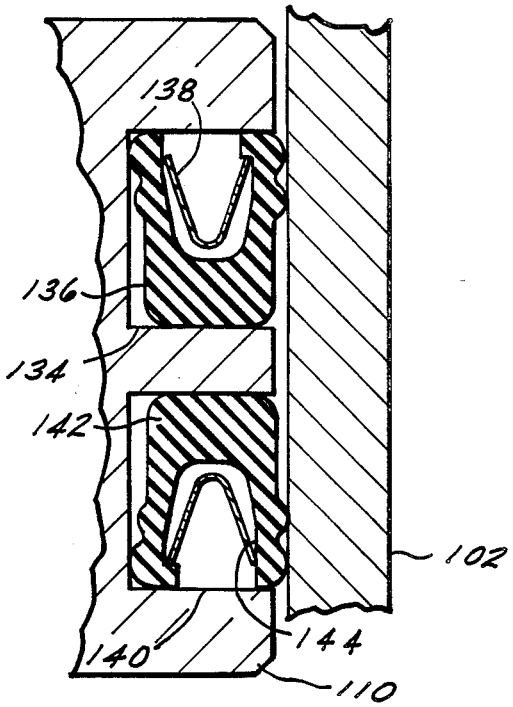
FIG. 5 shows a cross sectional view of a portion of the compressor of the present invention.

An alternative embodiment of the compressor 32 is shown in FIG. 5 in which two annular grooves 134 and 140 circumscribe piston 110. A pair of chemically resistant unidirectional seals 136 and 142 are disposed in grooves 134 and 140 respectively. Resilient members 138 and 144 urge seals 136 and 142 respectively toward tubular cylinder wall 102.

Valve 28 is normally closed and valve 40 is normally open. The discriminator chamber 12 includes float sensor 52 for sensing the level of liquid phase refrigerant fluid in the discriminator chamber 12. Sensor 52 is responsive to the level of liquid phase refrigerant fluid in the discrimination chamber 12 and provides a control signal if the discriminator chamber 12 is full of liquid phase refrigerant fluid. Actuators 30 and 42 are responsive to the control signal provided by sensor 52. In response to the control signal, actuator 42 closes valve 40 to prevent liquid from flowing from the discriminator chamber 12 to the compressor 32 and opens valve 28 to allow the liquid to drain from the discriminator chamber 12 through conduit 26 to receiver 6.

A bypass conduit 56 is provided to allow fluid to flow directly from condenser 34 to inlet port 8 of receiver 6. The bypass conduit 56 is provided with a solenoid valve 58 for controlling flow through conduit 56. An actuator 60 is provided to open and close solenoid valve 58. Valve 58 is normally closed. A pressure sensor 62 is responsive to the pressure within discriminator chamber 12 and provides a control signal if the pressure in discriminator chamber 12 falls below a predetermined value. Actuator 60 is responsive to the control signal from pressure sensor 62 and opens valve 58 in response to the control signal.

The recovery apparatus of the present invention includes a safety chamber 64. Safety chamber 64 includes an inlet port 66, a gas outlet port 68 and a liquid outlet port 70. A conduit 72 is provided for allowing fluid flow between port 10 of receiver 6 and inlet port 66 of safety chamber 64. Conduit 72 is provided with a solenoid valve 74 for controlling flow through conduit 72. An actuator 76 is provided for opening and closing solenoid valve 74. Conduit 78 allows fluid to flow from gas exit port 68 of safety chamber 64 to conduit 38 and on to compressor 32. Conduit 80 allows fluid to flow from liquid exit port 70 of safety chamber 64 to liquid inlet port 15 of discriminator chamber 12. Conduit 80 is provided with a solenoid valve 82 for controlling flow through conduit 80. An actuator 84 is provided for opening and closing solenoid valve 82.

Inlet tube 86 extends into receiver 6 through port 10 of receiver 6 to an open end 88.

If the level of liquid phase refrigerant within receiver 6 is below the open end 88 of inlet tube 86, gas phase refrigerant fluid flows through conduit 72, safety chamber 64 and conduit 78 to compressor 32.

As the receiver fills with refrigeration fluid, the liquid level rises until the liquid level reaches the end 88 of inlet tube 86. Once the liquid level in the receiver is at the level of the open end 88 of inlet tube 86, the introduction of additional refrigeration fluid into receiver 6 will result in liquid phase refrigerant being forced through conduit 72 and into inlet port 66 of safety chamber 64. Sensor 90 within safety chamber 64 is responsive to liquid level within safety chamber 64. When liquid phase refrigerant enters safety chamber 64, sensor 90 provides a control signal. Actuators 30, 42, and 76 and switch 33 are responsive to sensor 90 and close valves 28, 40 and 74 and cut power to the compressor 32, respectively, in response to the control signal from sensor 90.

The apparatus of the present invention has two modes of operation and may be used to recover refrigeration fluid from a refrigeration system (recovery mode) and to charge refrigeration fluid from receiver to a refrigeration system (charging mode).

In the recovery mode compressor 32 and condensor fan 46 are turned on. Compressor 32 lowers the pressure in receiver 6 as well as compressing the influent stream 38 of gas phase fluid. Fluid evaporates from the receiver 6 is directed through conduit 72, inlet 66 chamber 64, outlet 68, conduit 78 and is combined with influent gas stream 38. Evaporation of refrigerant fluid from receiver 6 lowers the temperature of the liquid phase fluid remaining in receiver 6. The apparatus maintains a pressure differential to drive fluid from refrigeration unit 2 to receiver 6 until substantially all refrigerant has been removed from the refrigeration unit.

In the charging mode, the compressor 32 is turned on, fan 46 is turned off, back pressure regulator 36 is closed and valve 58 is open. Fluid is evaporated from the receiver and compressed in the compressor 32 to form a high pressure elevated temperature stream of refrigerant fluid. The high pressure elevated temperature stream of refrigerant is introduced to the receiver 6 through conduit 26 to increase the pressure within receiver 6 and force fluid from receiver 6 through a conduit (not shown) to the refrigeration system 2 being charged.

The discrimination chamber of the present invention allows liquid phase refrigerant to bypass the compressor, condensor and backpressure regulator as it passes from the refrigeration unit to the refrigerant receiver and thereby allows refrigerant to be removed from the refrigeration unit in significantly less time than possible with the apparatus described in U.S. Pat. No. 4,766,733.

Conventional refrigerant receivers are provided with a safety valve in order to preclude the generation of internal pressures within a refrigerant receiver that exceed the pressure rating of the container. The safety valve opens at a predetermined maximum pressure that is below the maximum pressure rating of the receiver. In order to avoid generating internal pressures with a receiver that would trigger the safety valve, the amount of refrigerant introduced to a receiver must be controlled. Conventionally, refrigerant containers are filled by weight. In the context of recovering refrigerant from refrigeration units in the field, a weighing apparatus constitutes a cumbersome additional piece of equipment to transport. The safety chamber of the present invention allows control of the amount of refrigerant introduced to the receiver without requiring any equipment in addition to the apparatus of the present invention.

The features of the compressor of the present invention offer several benefits which are particularly advantageous in the context of refrigerant recovery. Conventional refrigeration compressors are typically heavy, cumbersome devices which include a thick cast iron cylinder wall. The compressors of the present invention is light weight and easily portable.

Typically the materials of construction of conventional refrigerant compressors are not reactant to impurities, e.g. acids, present in used refrigerant fluids. The compressor of the present invention is adapted for transferring contaminated refrigerants.

Conventional refrigeration compressors operate in closed loop refrigeration systems in which a lubricating oil migrates through the loop and continuously lubricates the compressor. The recovery of used refrigerant is inherently an open loop process. Each time the used refrigerant passes from the refrigeration system through the compressor into a receiver refrigerant compressor of the present invention is self lubricating.

Conventional refrigerant compressor include unidirectional seals and are unable to provide a vacuum intake stroke. The seals on the piston of the refrigerant compressor of the present invention are bi-directional and the refrigerant compressor of the present invention can therefore be used to pull the inlet pressure below atmospheric pressure, and allow a refrigerant system to be completely emptied of used refrigerant.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for recovering a compressible refrigeration fluid from a refrigeration system and delivering the recovered fluid to refrigerant receiver, comprising:

discriminator means for discriminating between gas phase refrigerant fluid and liquid phase refrigerant fluid;

first conduit means for directing a stream of fluid from the refrigeration system to the discriminator means;

second conduit means for directing a stream of liquid phase fluid from the discriminator means to the receiver;

means for condensing a stream of gas phase fluid from the discriminator means to form a low pressure stream of substantially liquid phase fluid;

third conduit means for directing the low pressure stream of substantially liquid phase fluid from the means for condensing to the receiver means; and vent means for directing a stream of gas phase fluid from the receiver to the means for condensing.

2. The apparatus of claim 1, wherein the discriminator means comprises:

a chamber having an inlet port for allowing the stream of fluid from the refrigeration system to enter the chamber, a first outlet port for allowing liquid phase fluid to exit the chamber and a second outlet for allowing gas phase fluid to exit the chamber;

sensor means for sensing the level of liquid phase fluid in the chamber and for generating first control signal if the chamber is full of liquid phase fluid and a second control signal if there is no liquid phase refrigeration in the chamber;

first valve means for closing said first outlet port;

second valve means for closing said second outlet port;

first actuator means responsive to said first control signal, for opening said first valve means to allow liquid phase fluid to exit said first outlet port; and second actuator means, responsive to said second control signal, for opening said second valve means to allow gas phase fluid to exit said second outlet port.

3. The apparatus of claim 2, wherein said means for condensing comprises:

compressor means, in flow connection with said second outlet port of the chamber for compressing the stream of gas phase fluid to form a stream of compressed gas phase fluid;

condenser means, in flow connection with said compressor means, for condensing the stream of compressed gas phase fluid to form a stream of substantially liquid phase fluid;

expansion means, in flow connection with said condenser means, for lowering the pressure of the stream of substantially liquid phase fluid.

4. The apparatus of claim 3, further comprising:

bypass means for directing the stream of substantially liquid phase fluid from the condenser means directly to the receiver means;

second sensor means for sensing the pressure of the fluid in the chamber of the separator means, said second sensor means providing a third control signal when the pressure in the chamber is below a predetermined pressure;

third valve means for closing said bypass means; and third actuator means for opening said third valve means in response to the third control signal.

5. The apparatus of claim 1, further comprising a fourth conduit means which comprises:

safety means for limiting the quantity of fluid directed to the receiver, said safety means comprising:

a safety chamber, said safety chamber having a inlet means for allowing fluid from the receiver to enter the safety chamber, gas outlet means for allowing gas phase fluid to flow from the chamber to the means for condensing and liquid exit means for allowing liquid phase fluid to flow from the safety chamber to the separator means;

valve means for preventing flow of fluid to the receiver;

sensor means, responsive to the presence of liquid phase fluid in the safety chamber, for providing a sensed signal indicative of the presence of liquid in the safety chamber;

actuator means, responsive to the sensed signal, for actuating valve means to prevent fluid from entering the receiver.

6. The apparatus of claim 5, further comprising second actuator means, responsive to the sensed signal, for inactivating said means for condensing, and wherein the valve means comprises means for closing said vent means to prevent flow of fluid from the receiver.

7. The apparatus of claim 5, further comprising second actuator means, responsive to said sensed signal, for inactivating said means for condensing and wherein said valve means comprises:

gas valve means for preventing flow of gas phase fluid from the discriminator means to the means for condensing; and liquid valve means for preventing flow of liquid phase fluid from the discriminator to the receiver.

8. An apparatus of claim 3, wherein the compressor means comprising:

a tubular stainless steel cylinder wall, having first and second open ends, a cylinder head enclosing the second end of the tubular wall defining an intake port and an outlet port, valve means for controlling flow through the intake and outlet ports, a piston slidably received within the tubular cylinder wall, means for reciprocally moving the piston within the tubular cylinder wall to provide an intake stroke and an outlet stroke, and self lubricating, bi-directional annular seal means for sealing between the piston and the tubular cylinder wall so that the apparatus provides a high pressure outlet stroke and a vacuum intake stroke.

9. The apparatus of claim 8, wherein an annular groove circumscribes the piston and the seal means comprises a fluoropolymeric ring disposed in the annular groove and an elastomeric ring disposed within the groove between the piston and the fluoropolymeric ring for urging the fluoropolymeric ring toward the tubular cylinder wall.

10. The apparatus of claim 8, wherein the piston includes a first annular groove circumscribing to piston and a second annular groove circumscribing the piston and spaced apart from the first annular groove and wherein the seal means comprises a first fluoropolymeric ring disposed within the first groove for sealing between the piston and the tubular cylinder wall to provide the high pressure outlet stroke and a second fluoropolymeric ring disposed within the second groove for sealing between the piston and the tubular cylinder wall to provide the vacuum intake stroke.

11. A process for recovering a refrigerant fluid from a refrigeration system and delivering the recovered refrigerant fluid to a refrigerant receiver, comprising:

discriminating between gas phase refrigerant and liquid phase refrigerant to provide a stream of gas phase refrigerant from the refrigeration unit and a stream of liquid phase refrigerant to the receiver;

condensing the stream of gas phase fluid to form a low pressure stream of substantially liquid phase fluid;

directing the low pressure stream of substantially liquid phase fluid to the receiver;

venting gas phase refrigerant from the receiver; and directing the gas phase fluid from the receiver to the stream of gas phase refrigerant.

* * * * *